US011756513B1

(12) United States Patent
Burgett

(10) Patent No.: US 11,756,513 B1
(45) Date of Patent: Sep. 12, 2023

(54) ELLIPTICAL SILICONE ROLLER FOR GRAND PIANO ACTION WITH CUSTOMIZED DUROMETER READING

(71) Applicant: Kirk Burgett, Sacramento, CA (US)

(72) Inventor: Kirk Burgett, Sacramento, CA (US)

( * ) Notice: Subject to any disclaimer, the term of this patent is extended or adjusted under 35 U.S.C. 154(b) by 0 days.

(21) Appl. No.: 17/878,224

(22) Filed: Aug. 1, 2022

(51) Int. Cl.

| | |
|---|---|
| ***G10D 3/18*** | (2020.01) |
| ***G10C 3/18*** | (2006.01) |
| ***G10C 3/166*** | (2019.01) |
| ***G10C 3/22*** | (2019.01) |

(52) U.S. Cl.
CPC ..... *G10C 3/18* (2013.01); *G10C 3/166* (2013.01); *G10C 3/22* (2013.01)

(58) Field of Classification Search
CPC ..... G10C 3/18; G10C 3/166; G10C 3/22
See application file for complete search history.

(56) References Cited

FOREIGN PATENT DOCUMENTS

JP H10222156 A * 8/1998 ..... G10C 3/18

* cited by examiner

*Primary Examiner* — Kimberly R Lockett
(74) *Attorney, Agent, or Firm* — Craig A. Simmermon

(57) ABSTRACT

Elliptical silicone knuckle or roller for grand piano action with customized durometer reading is an elliptical cylinder shaped knuckle or roller for a grand piano hammer assembly with an elliptical cylinder shaped core that is made of silicone thermoset resin material, which can be molded or manufactured at any desired durometer reading of 10-100 units to yield a piano action and hammer assembly for a grand piano with the exact feel of escapement that is desired by any particular pianist. Escapement is the process whereby the jack stops driving the knuckle just before the hammer hits the strings where the hammer travels the last 1 to 2 mm to the strings on its own inertia and without any contact with the jack. Two embodiments of elliptical silicone knuckle or roller are presented: a wide embodiment and a narrow embodiment.

2 Claims, 19 Drawing Sheets

Flg. 17

ELLIPTICAL SILICONE ROLLER FOR GRAND PIANO ACTION WITH CUSTOMIZED DUROMETER READING

BACKGROUND OF THE INVENTION

1. Field of the Invention

This invention relates to a knuckle or a roller in a grand piano action. A grand piano produces sound as a result of a complicated mechanical chain reaction which starts with the pianist depressing a piano key which in turn actuates a piano action associated with the key which in turn rotates a hammer assembly associated with the piano action which in turn causes a hammer to rotate and strike a piano string or strings to make sound. Every grand piano has 88 keys that are each associated with one piano action and one hammer assembly. Thus, a grand piano has 88 piano actions and 88 hammer assemblies. Each piano action has a jack component that contacts and lifts a knuckle or roller attached to the hammer assembly in order to rotate a hammer and strike the piano string or strings to make sound. Specifically, this invention is a specially designed and shaped knuckle or roller made of a non-permeable thermoset silicone material with elliptic cylinder shape and a precise durometer reading or softness, which greatly increases the lifespan of the hammer assembly as well as drastically improve the "feel" of the piano action by improving the escapement characteristics of the piano action as described below. The end result is a substantial increase in longevity of piano actions and hammer assemblies as well as a dramatic improvement in the feel of playing a piano equipped with the specially designed and shaped knuckle or roller. A typical grand piano has a lifespan of about 75 years and traditional knuckles or rollers require maintenance every 3-6 years whereas the knuckles or rollers of this invention only require maintenance every 20-30 years.

2. Description of Related Art

The knuckle or roller plays a crucial role a piano action and a hammer action because it is the interface between the jack and the hammer shank. The jack drives the hammer shank and allows escapement. Escapement is one of the defining characteristics of a piano and a piano action. The escapement process is necessary because the hammer cannot be driven directly into the piano strings. If the hammer were driven directly into the piano strings, the hammer would mute the vibration of the piano strings if it stayed on the piano strings. Escapement is the process whereby the jack ceases driving the knuckle just before the hammer hits the strings wherein the hammer travels the last 1 to 2 mm to the strings on its own inertia and without any contact with the jack. With the jack out of the way, the hammer is able to rebound from the piano strings, leaving the strings free to vibrate. In order to facilitate escapement, the knuckle or roller has been traditionally round or cylindrical shaped. The round or cylindrical shaped knuckle or roller has been around since about 1850. The round or cylindrical shape allows the jack to slide off of the knuckle or roller to discontinue contact with the knuckle or roller during the piano action cycle. Hence the name roller. The point of discontinued contact between the jack and the knuckle or roller is the point of escapement. The point of escapement is crucial to the feel of the piano key, piano action, and piano. The feel of a piano action and a piano is primarily defined by how and when the jack slides off the knuckle or roller during the cycling of a piano action. Pianists discern escapement properties of piano actions and pianos in order to choose a piano that feels best to them. Pianists choose a piano with escapement that is smooth, with the proper amount of resistance, and "feels right" to them. The shape and material properties of the knuckle are very important to the escapement properties and the overall feel of a piano action.

Traditionally a knuckle or roller has a wooden spline approximately 2 mm thick surrounded by shaped felt and wrapped with soft smooth buckskin. The knuckle or roller is attached to the hammer shank by gluing the spline into a slot on the underside of the hammer shank. The felt core must be artfully shaped and glued to the spline and the buckskin must be properly stretched and wrapped to produce a cylindrical shape with a certain degree of softness or elasticity to yield the proper escapement and overall feel of the piano action. If the felt is too hard or the buckskin is stretched too tight, the knuckle will make noise as it impacts the jack and repetition or balancier to sound and feel clunky. If the felt is too soft, the knuckle will lose its shape and will flatten in a short period of time and need replacement. Even when the felt is shaped and packed perfectly and the buckskin is wrapped at the perfect tension, all knuckles will flatten within about 3-6 years because all cloth and felt loses resilience with age because the fibers dry out or loose oils and become brittle over time and all buckskin dries out and loses the oils transferred to it during the tanning process to become brittle. Buckskin has been replaced with synthetic buckskin to help eliminate some of these problems. However, even synthetic buckskin loosens from its original stretched tension over the years and more importantly the felt inside loses resilience with age because the fibers dry out or loose oils and become brittle over time, thereby causing the knuckle to still fail in 3-6 years.

Felt is a textile material that is produced by matting, condensing, and pressing fibers together. Felt can be made of natural fibers such as wool or animal fur, or from synthetic fibers such as petroleum-based acrylic or acrylonitrile or wood pulp-based rayon. Blended fibers are also common. All felt is a fibrous and porous material meaning that air fills a great deal of space within the layers of the textile. Although felt was the best material to use in a knuckle or roller core for many many years, in modern times, applicant has created an improved knuckle or roller core that is made of non-permeable thermoset resilient silicone material with the correct softness or resilience to yield a piano action with as good an overall feel or better than piano actions made with the traditional cylindrical felt knuckle cores. A non-permeable thermoset material is necessary to extend the lifespan of the core well beyond that of a felt core. A non-permeable thermoset material does not have air inside of it to act as a drying agent to remove oils and chemical treatments which inevitably occurs causing all felt to dry out. A silicone resin is necessary to yield the proper softness, elasticity, resilience or durometer reading. Applicant uses a variety of proprietary silicone material recipes to yield knuckle cores with the exact durometer reading or softness reading required to yield the precise escapement feel that is desired by a particular pianist. Applicant produces different cores with different durometer readings. Further, applicant has re-shaped the round or cylindrical core into an oval or elliptic cylinder shaped core which greatly improves the overall feel of the piano action as discussed below. There are no other knuckles or rollers for a grand piano action in the prior art with an oval or elliptic cylinder shaped core made of non-permeable thermoset resilient silicone material with a durometer measurement that is similar to that of shaped knuckle felt.

BRIEF SUMMARY OF THE INVENTION

It is an aspect of elliptical silicone roller for grand piano action with customized durometer reading to have a core that is made of non-permeable thermoset silicone with a durometer reading of 40-100 by type A scales.

It is an aspect of elliptical silicone roller for grand piano action with customized durometer reading to have a core that is a solid elliptic cylinder with a longitudinal rectangular slot running across the entire outer surface of the core.

It is an aspect of elliptical silicone roller for grand piano action to have a core that is injection molded with a non-permeable thermoset silicone material that can be customized and molded with an exact targeted durometer reading or softness.

It is an aspect of certain embodiments of elliptical silicone roller for grand piano action to have a core with an exact durometer reading at any desired integer unit between 40-100 units.

It is an aspect of elliptical silicone roller for grand piano action with customized durometer reading to have a core with the exact softness or durometer reading that is desired by a particular pianist to yield the desired escapement feel of the piano action and the hammer action.

It is an aspect of elliptical silicone roller for grand piano action with customized durometer reading to have a core with a greatly improved lifespan of 20-30 years so that the knuckle or roller will not need maintenance or replacement for 20-30 years.

It is an aspect of elliptical silicone roller for grand piano action with customized durometer reading to include a buckskin or wear cloth that is not stretched over the core but rather is glued over the core without any increased tension or stretching.

It is an aspect of one embodiment of elliptical silicone roller for grand piano action to have a wider than usual core wherein the elliptical shape of the core is positioned so that the major axis of the elliptical shape is parallel with the attachment surface of the hammer shank or tubular lever interface to which the elliptical silicone roller is attached and glued.

It is an aspect of one embodiment of elliptical silicone roller for grand piano action to have a narrower than usual core wherein the elliptical shape of the core is positioned so that the minor axis of the elliptical shape is parallel with the attachment surface of the hammer shank or tubular lever interface to which the elliptical silicone roller is attached and glued.

It is an aspect of certain embodiments of elliptical silicone roller for grand piano action to yield a piano action and hammer action with an escapement feel that is much smoother, longer, and dampened than usual thereby diminishing the noticeability of escapement. These embodiments have the wide core embodiment with a durometer reading of 40-60 units where the lower the durometer reading the more dampened the feel of escapement.

It is an aspect of certain embodiments of elliptical silicone roller for grand piano action to yield a piano action and hammer action with an escapement feel that is much harder, quicker, and with more of a bump than usual thereby increasing the noticeability of escapement as much as possible. These embodiments have the narrow core embodiment with a durometer reading of 70-90 units where the higher the durometer reading the less dampened the feel of escapement so that the pianist feels more of a bump through their fingertips at escapement.

DEFINITION LIST

Figure 1:
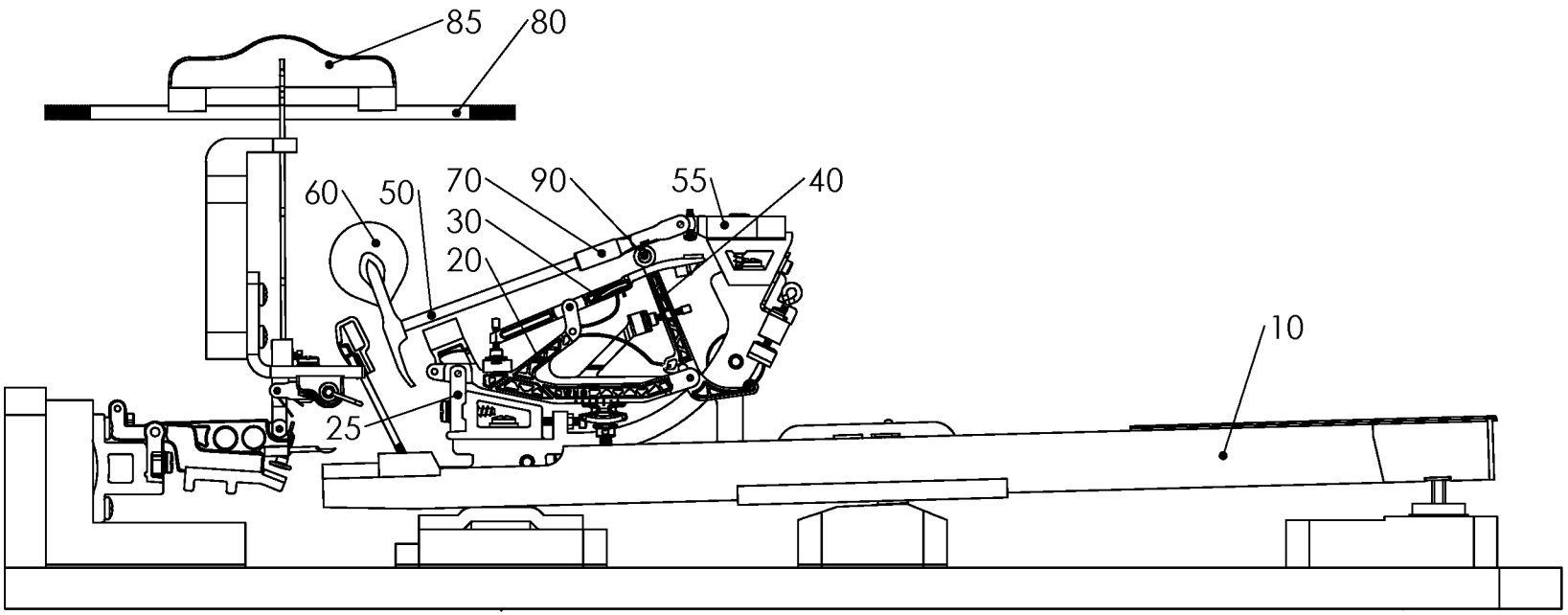
FIG. 1 is a side view of piano action and hammer action for a grand piano. The piano action and hammer action depicted is applicant's patented piano action and patented hammer action.

| Term | Definition |
|---|---|
| 5 | Elliptical Silicone Roller for Grand Piano Action with Customized Durometer Reading |
| 10 | Piano Key |
| 20 | Wippen or Repetition |
| 25 | Wippen or Repetition Flange |
| 30 | Repetition Lever or Balancier |
| 40 | Jack |
| 50 | Hammer Shank |
| 55 | Hammer Shank Flange |

-continued

| Term | Definition |
|---|---|
| 60 | Hammer |
| 70 | Tubular Lever Interface |
| 75 | Scale on Tubular Lever Interface |
| 80 | Piano Strings |
| 85 | Damper Head |
| 90 | Prior Art Knuckle or Roller |
| 100 | Elliptical Silicone Knuckle or Roller |
| 110 | Spline |
| 112 | Horizontal Base Member |
| 114 | Vertical Upright Member |
| 115 | Recess Area on Horizontal Base Member |
| 116 | Protrusion Area on Horizontal Base Member |
| 117 | Pointer on Base Horizontal Member |
| 118 | Location Mark on Horizontal Base Member |
| 119 | Half Round Shape on Horizontal Base Member |
| 120 | Elliptical Silicone Core |
| 122 | Rectangular Slot |
| 130 | Buckskin or Wear Cloth |

DETAILED DESCRIPTION OF THE INVENTION

A piano produces sound through a complicated mechanical chain reaction that occurs in the piano action which can be summarized as follows. A depressed piano key 10 gives rise to motion of the damper head assembly, separating the damper head 85 from the associated set of piano strings 80 and setting the piano strings 80 ready to accept vibrations. The depressed key 10 also actuates the piano action by pushing upwards on the wippen or repetition 20 to rotate the wippen or repetition 20 causing the wippen or repetition 20 to rotate upwards which pushes the repetition lever or balancier 30 and the jack 40 upwards. Since the repetition lever or balancier 30 and the jack 20 are in contact with the knuckle or roller 90 at the rest position, the upwards movement of the repetition lever or balancier 30 and the jack 40 causes the hammer assembly to rotate. The upwards movement of the repetition lever or balancier 30 and the jack 40 pushes upwards on the knuckle or roller 90 which is attached to the base of the hammer shank 50. The upwards movement of the knuckle or roller 90 causes the hammer shank 50 and the hammer 60 to rotate thereby pushing or "throwing" the hammer 60 and hammer shank 50 into the associated set of piano strings 80. The hammer 60 strikes the piano strings 80 and generates a piano tone. The piano action then receives or "catches" the hammer 60 and hammer shank 50 after it strikes the piano strings 80 and rebounds back against the piano action. When the pianist releases the depressed piano key 10, the piano key 10 returns to the rest position, and permits the damper head assembly to return contact with the vibrating piano strings 80. The vibrations are absorbed by the damper head 85, and the piano tone is terminated.

A traditional grand piano action comprises: a piano key 10; a wippen or repetition 20; a wippen or repetition flange 25; a repetition lever or balancier 30; a jack 40; a hammer shank 50; a hammer shank flange 55; a hammer 60; and a knuckle or roller 90. Applicant has improved the traditional hammer assembly design with U.S. Pat. No. 8,143,506 entitled "HAMMER ASSEMBLY FOR GRAND PIANO" wherein a grand piano action comprises: a piano key 10; a wippen or repetition 20; a wippen or repetition flange 25; a repetition lever or balancier 30; a jack 40; a hammer shank 50; a hammer shank flange 55; a hammer 60; a tubular lever interface 70; and a moveable knuckle or roller 95. Both of these designs include knuckles or rollers 90,95 with cylindrical shaped cores that are made of wrapped felt material. Applicant has further improved the grand piano hammer assembly and piano action to include an elliptical silicone knuckle or roller 100 as discussed below.

Elliptical silicone knuckle or roller 100 is moveable in that it may be positioned and attached to tubular lever interface 70 at various locations along the length of tubular lever interface 70 as described in U.S. Pat. No. 8,143,506 entitled "HAMMER ASSEMBLY FOR GRAND PIANO" in order to vary the distance between the hammer shank center-of-rotation and the knuckle center-line which in turn allows this universal hammer assembly to be adjusted in order to properly fit any brand of grand piano or any grand piano. Thus, elliptical silicone knuckle or roller 100 includes the moveable aspects and properties of the moveable knuckle described in U.S. Pat. No. 8,143,506 entitled "HAMMER ASSEMBLY FOR GRAND PIANO", wherein, the moveable knuckle is improved here with the elliptical silicone knuckle or roller 100 as discussed throughout.

Elliptical silicone knuckle or roller 100 comprises: a spline 110; an elliptical silicone core 120, and a buckskin or wear cloth 130.

Spline 110 comprises: a horizontal base member 112 and a vertical upright member 114.

Horizontal base member 112 is a rigid rectangular planar member with an upper surface, a lower surface, a front edge, a rear edge, a left edge, a right edge, a length, a width, a thickness, and a longitudinal bisect. The longitudinal bisect is an axis that runs from the left edge to the right edge that exactly bisects horizontal base member 112 into two equal size longitudinal halves. Horizontal base member 112 includes at least one recess area 115 and at least one protrusion area 116. At least one recess area 115 is an indentation or concave area on the lower surface of horizontal base member 112. At least one protrusion area 116 is a projection or convex area on the lower surface of horizontal base member 112. At least one recess area 115 and at least one protrusion area 116 function to mate with at least one recess area (not depicted) and at least one protrusion area (not depicted) on the tubular lever interface 70 as described in U.S. Pat. No. 8,143,506 entitled "HAMMER ASSEMBLY FOR GRAND PIANO".

At least one protrusion area 116 further comprises a pointer 117. Pointer is a protrusion or projection on the lower surface of horizontal base member 112 that is shaped like an arrowhead, pointer, or a point. Pointer 117 functions to mate with the tubular lever interface 70 as described in U.S. Pat. No. 8,143,506 entitled "HAMMER ASSEMBLY FOR GRAND PIANO".

Horizontal base member 112 further comprises two location marks 118. Each location mark 118 is a protrusion or recess on the left side and the right side of horizontal base member 112. Each location mark is a line with a longitudinal axis that is perpendicular to the plane of horizontal base member 112. The longitudinal axis of each location mark is coincident with the longitudinal bisect of horizontal base member 112. Each location mark has an upper end a lower end. The lower end of location mark is adjacent to the lower surface of horizontal base member 112. Location marks 118 function to indicate the position of elliptical silicone knuckle or roller 100 relative to tubular lever interface 70 according to a scale 75 located on the tubular lever interface 70. As discussed in U.S. Pat. No. 8,143,506 entitled "HAMMER ASSEMBLY FOR GRAND PIANO", location marks 118 function to indicate the distance between the hammer shank center-of-rotation and the knuckle center-line as referenced on scale 75 on tubular lever interface 70.

Vertical upright member 114 is a rigid rectangular planar member with an upper edge, a lower edge, a front surface, a rear surface, a left edge, a right edge, a length, a width, and a thickness.

The lower edge of vertical upright member 114 is rigidly attached to the upper surface of horizontal base member 112 along the longitudinal bisect of the horizontal base member 112 wherein the plane of vertical upright member 114 is perpendicular to the plane of horizontal base member 112. Rigid attachment may be accomplished by any known means.

Horizontal base member 112 and vertical upright member 114 may be made from any known material.

In best mode, horizontal base member 112 and a vertical upright member 114 are integral or one-piece and made from plastic or composite material.

Elliptical silicone core 120 is a solid silicone elliptic cylinder shaped member with a left end, a right end, an outer surface, a length, a longitudinal axis, a major axis radius, a minor axis radius, and a length. As with any elliptic cylinder, there is a major axis radius and a minor axis radius that is perpendicular to the major axis radius. The major axis radius is larger than the minor axis radius which yields the elliptical shape. A regular cylinder just has one radius that is the same length which yields a cross section that is a perfect circle. An elliptic cylinder has a larger radius on one axis and a smaller radius on the axis perpendicular to that which yields an elliptical cross section. Elliptic cylinder is a cylinder as defined according to its normal defection in the dictionary and text books. The major axis radius of elliptical silicone core 120 is 8-11 mm. The minor axis radius of elliptical silicone core 120 is 8-11 mm. The major axis radius is always larger than the minor axis radius by at least 1 mm.

Elliptical silicone core 120 further comprises a rectangular slot 122 in its outer surface. Rectangular slot 122 has a left end, a right end, a depth, a width, a length, and a longitudinal axis. The longitudinal axis of rectangular slot 122 is parallel with the longitudinal axis of solid resilient elliptic cylinder shaped member. The left end of rectangular slot 122 is coincident with the left end of elliptical silicone core 120 and the right end of rectangular slot 122 is coincident with the right end of elliptical silicone core 120. The left end of rectangular slot 122 breaks out of the left end of elliptical silicone core 120 as depicted. The right end of rectangular slot 122 breaks out of the right end of elliptical silicone core 120 as depicted. The depth of rectangular slot 122 is sized to be the width of vertical upright member 114 plus the thickness of buckskin or wear cloth 130, or slightly larger to allow clearance. The width of rectangular slot 122 is sized to be the thickness of vertical upright member 114, or slightly larger to allow clearance. The depth and width of rectangular slot 122 are sized to make a clearance fit of a slip fit with the width of vertical upright member 114 plus the thickness of buckskin or wear cloth 130 and the thickness of vertical upright member 114 respectively so that the vertical upright member 114 slides perfectly into rectangular slot 122 with a clearance fit or slip fit for gluing and permanent attachment thereto. Rectangular slot 122 functions to provide a socket, groove, or mortise into which vertical upright member 114 may be inserted and glued in order to rigidly attach elliptical silicone core 120 to spline 110.

Buckskin or wear cloth 130 is a woven or non-woven fabric, textile, or cloth. Buckskin or wear cloth 130 may be natural buckskin or synthetic buckskin. Buckskin or wear cloth 130 may be any known type of fabric, textile, or cloth.

Buckskin or wear cloth 130 is a rectangular piece of fabric, textile, or cloth with inner surface, an outer surface, a length, width, and a thickness. The width of buckskin or wear cloth 130 is equivalent to the length of elliptical silicone core 120 and the length of buckskin or wear cloth 130 is equivalent to circumference of elliptical silicone core 120 minus the thickness of vertical upright member 114. The inner surface of buckskin or wear cloth 130 is attached to or glued to the outer surface of elliptical silicone core 120 so that the buckskin or wear cloth 130 evenly covers the outer surface of the elliptical silicone core 120 without any overhang over the left or right ends of the elliptical silicone core 120 and without any overhang over the rectangular slot 122. The buckskin or wear cloth 130 is not stretched during this attachment and gluing process but rather is draped and attached without any increased tension or pulling. Applicant has discovered that unstretched buckskin or wear cloth 130 lasts at least three times longer than stretched buckskin or wear cloth 130. This is attributed to a decrease in the lifespan of fibers that have been stretched which causes them to become thinner, lose tensile strength, and contact more air which eventually dries out the fibers of the fabric, textile, or cloth. Buckskin or wear cloth 130 may be attached to or glued to elliptical silicone core 120 before or after attaching the elliptical silicone core 120 to the spline 110. Any known method of attachment may be used such as weld, solder, glue, epoxy, or adhesive. In best mode, attachment is accomplished by gluing.

Elliptical silicone core 120 is made of non-permeable thermosetting silicone material. Silicone resins are man-made elastomers that combine high-heat resistance with good cold performance to produce a material that has many advantages over other elastomers. An elastomer is a polymer that is both viscous and elastic. Other elastomers include butyl, fluorocarbon, neoprene, nitrile, polysulfide, and natural rubber. Silicone resins generally produce thermoset products but there has been success in current years with the development of thermoplastic elastomers, or TPEs, which can be remelted. Silicone resins are manufactured in three primary forms: LSR or liquid silicone rubber, RTV or room temperature vulcanizing silicone rubber, and HTV or high-temperature vulcanizing silicone rubber. LSR is used to make a host of heat-resistant parts in everyday use such as spatula blades. RTV silicone rubbers are used to make cure-in-place engine gaskets and other gaskets. HTV silicone rubbers are usually compression molded to produce all manner of medical and industrial products or extruded into various cross-sectional shapes. Silicone differs from most elastomers in that it is silica and oxygen-based with hydrocarbon side groups rather than carbon and hydrogen-based. The silica-oxygen-silica atoms form the backbone of the molecule, siloxane, to which organic molecules attach. Although its mechanical properties are poor, the material is able to maintain these properties over the range of its working temperature, from −70° C. to 250° C. and remain soft and elastic.

Elliptical silicone core 120 is made of solid silica gel silicone material which is a type of HTV or high-temperature vulcanizing silicone rubber. The raw material for solid silica gel molding is a solid. After the silicone rubber product manufacturer is mixed by a mixer, a catalyst is added, and then cut it into an appropriate size and manually put it into the mold cavity to form and cure. Typically, the molding method requires a manual operation to fill the mold with resin and the remove the part from the mold. Solid silica gel is industrially made with sodium silicate as a raw material that is hydrolyzed in an acid medium to form a gel and then made into silica gel through aging, washing, and drying. The end resin product has irregular granular, spherical, and micro spherical silica gels, which are usually used as catalysts for vulcanization. In this case, the solid silica gel is used as the base material for molding the parts.

Applicant has found that solid silica gel silicone material is the only material on the market at the time of this writing that can yield the proper durometer readings and also deliver the longevity properties required for a knuckle or roller to last 20-30 years without maintenance or replacement. Vulcanized solid silica gel is nonpermeable so that air will not permeate into the interior of the material or below the surface of the material to act as a drying agent.

Elliptical silicone core 120 is resilient with a durometer reading of 40-100 by type A scales. Elliptical silicone core 120 can be made with any desired softness of durometer reading between the range of 40-100 by type A scales by an accuracy of plus or minus 1 unit by type A scales. Thus, elliptical silicone core 120 can be made to any integer durometer reading between 40-100 units that is desired or preferred by any particular pianist. A durometer or shore durometer is a device used to measure the hardness of a material, typically of polymers, elastomers, and rubbers. Higher numbers on the scale indicate a greater resistance to indentation and thus are harder materials. Lower numbers indicate less resistance and are softer materials. There are several scales of durometer that are used for materials with different properties. The two most common scales are the ASTM D2240 type A and type D scales. The A scale is for softer materials and is what is used by Applicant. Traditional shaped knuckle felt that has been formed into a proper knuckle core has a durometer reading of about 60-70 by type A scales. Prior art knuckle cores have a durometer reading of 60-70 units. A durometer reading of 60 in traditionally considered "soft". A durometer reading of 70 is traditionally considered "hard". Elliptical silicone core 120 can be made with a durometer reading of 60-70 to thereby match the exact range of softness of traditional shaped knuckle felt. However, as discussed throughout, certain pianists prefer their knuckles or rollers 90 to be softer than average with durometers readings of 40-60 by type A scales, while other pianists prefer their knuckles or rollers 90 to be harder than average with durometers readings of 70-100 by type A scales. In this spirit, applicant has created elliptical silicone cores 120 in every integer durometer reading between 40-100 units by type A scales. Applicant's ability to produce elliptical silicone knuckles or rollers 100 custom tailored to a certain durometer reading is a remarkable and highly desired innovation among pianists and in the world of grand pianos.

Figure 4:
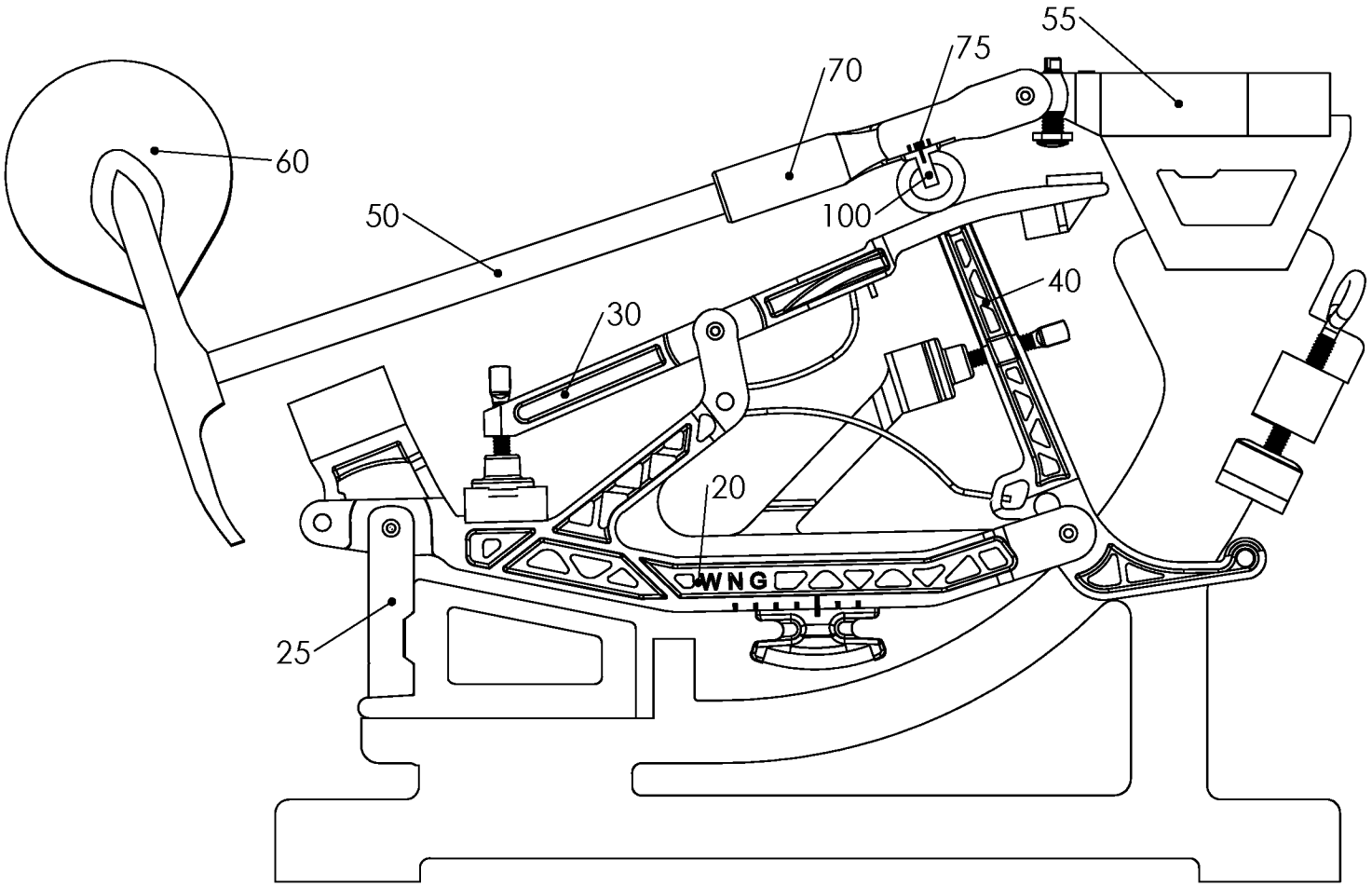
FIG. 4 is a side view of a piano action and hammer action with the wide embodiment of elliptical silicone knuckle or roller with the piano action and hammer action at rest.
Figure 5:
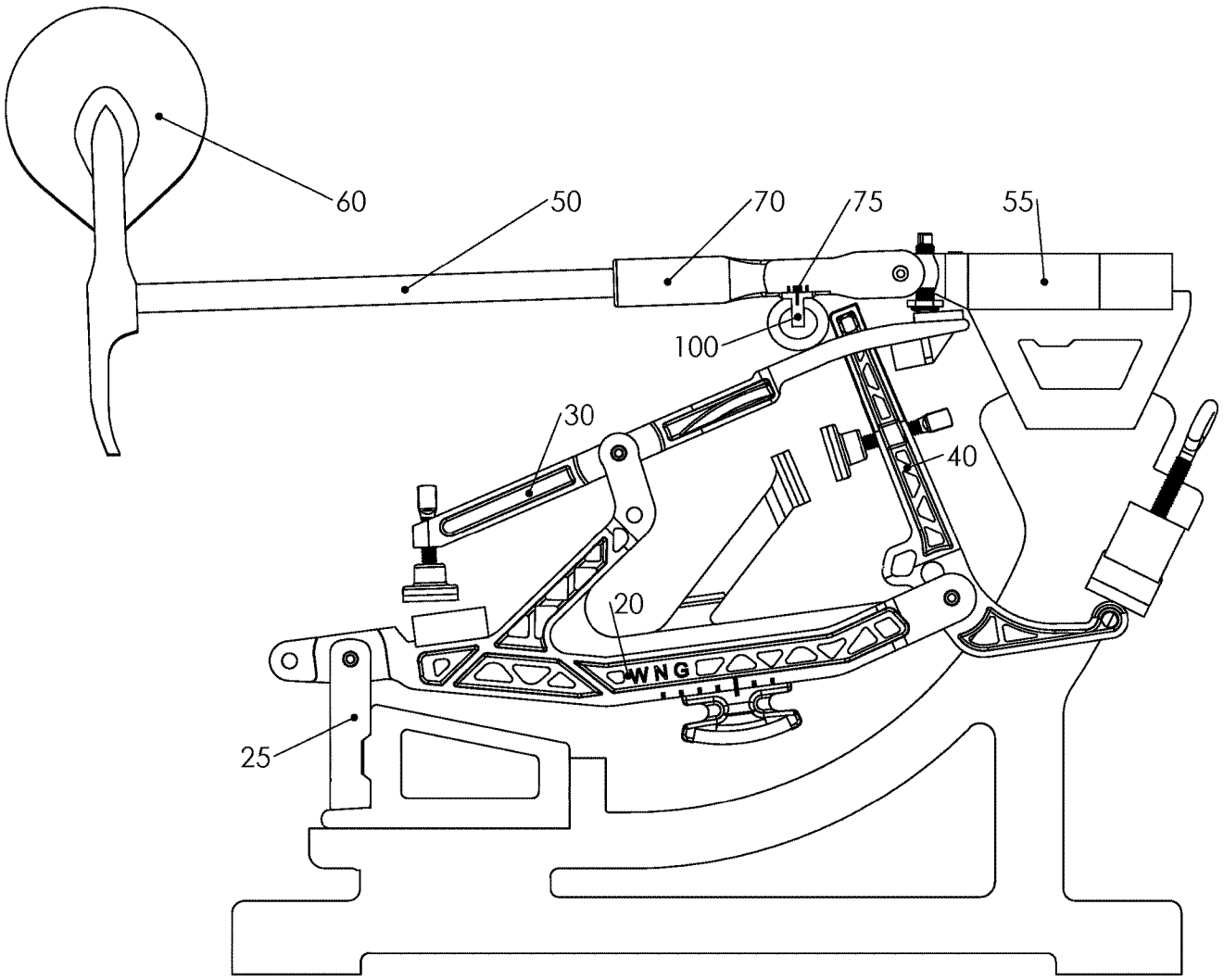
FIG. 5 is a side view of a piano action and hammer action with the wide embodiment of elliptical silicone knuckle or roller with the piano action and hammer action at the exact point of escapement.
Figure 6:
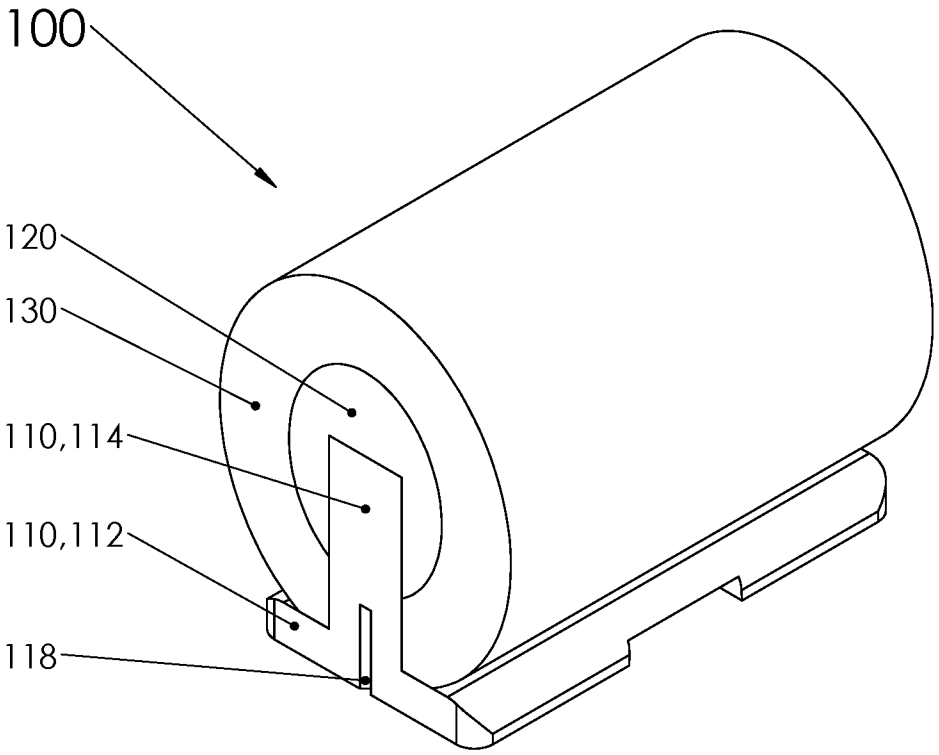
FIG. 6 is a perspective view of the narrow embodiment of elliptical silicone knuckle or roller.
Figure 7:
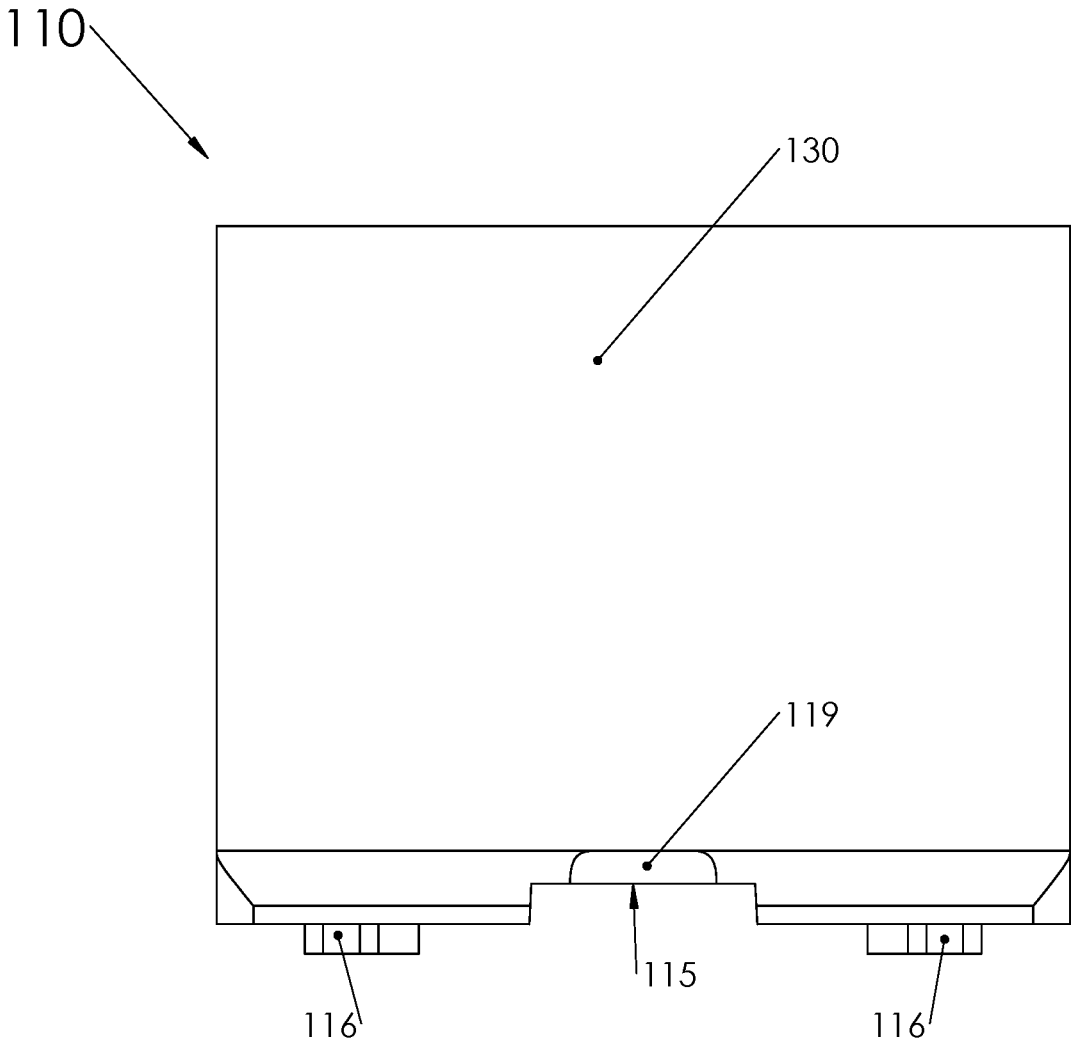
FIG. 7 is a front elevation view of the narrow embodiment of elliptical silicone knuckle or roller.
Figure 8:
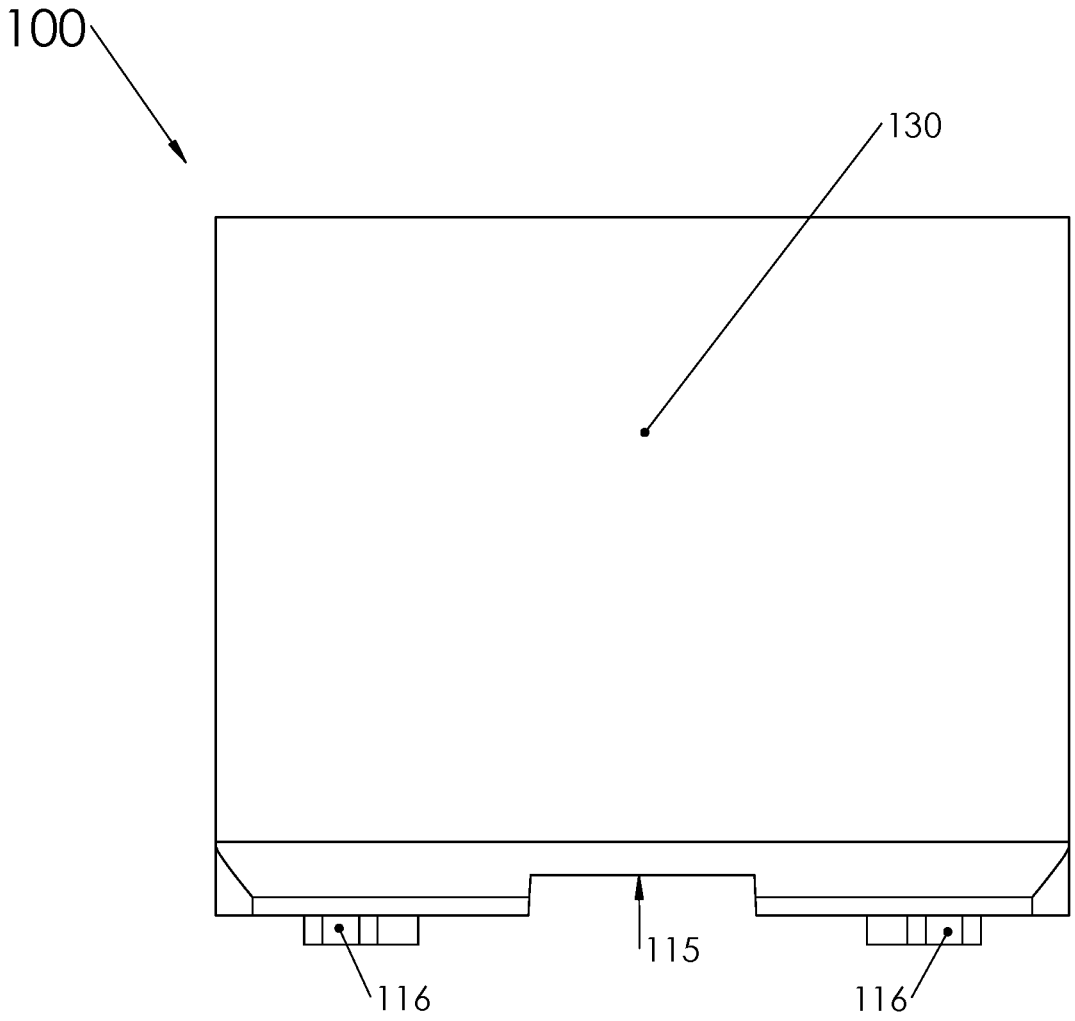
FIG. 8 is a rear elevation view of the narrow embodiment of elliptical silicone knuckle or roller.
Figure 9:
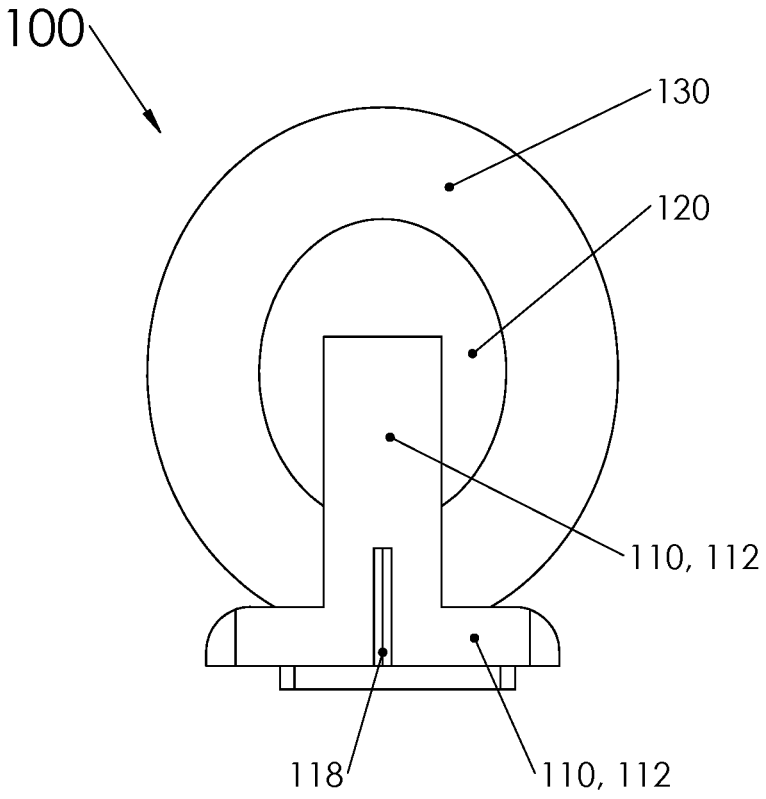
FIG. 9 is a left side elevation view of the narrow embodiment of elliptical silicone knuckle or roller.
Figure 10:
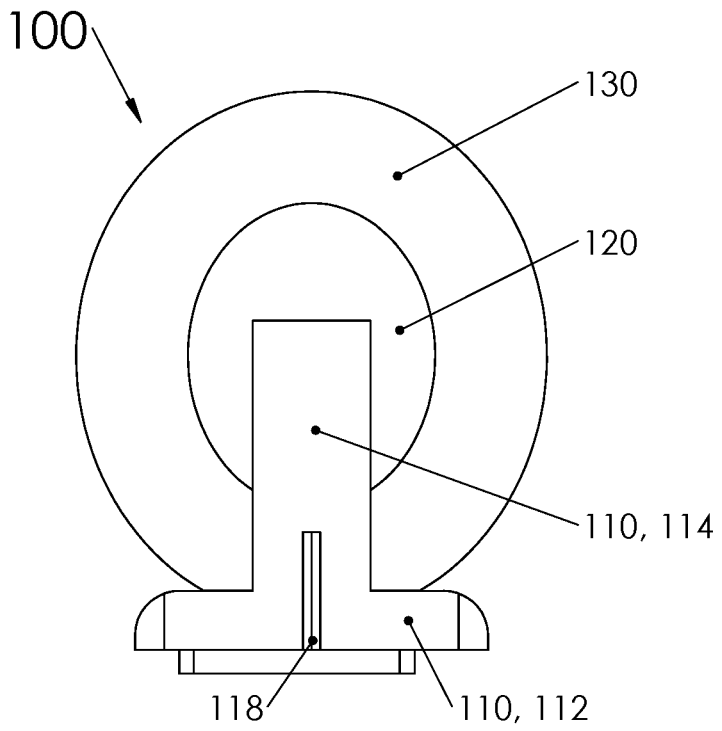
FIG. 10 is a right side elevation view of the narrow embodiment of elliptical silicone knuckle or roller.
Figure 11:
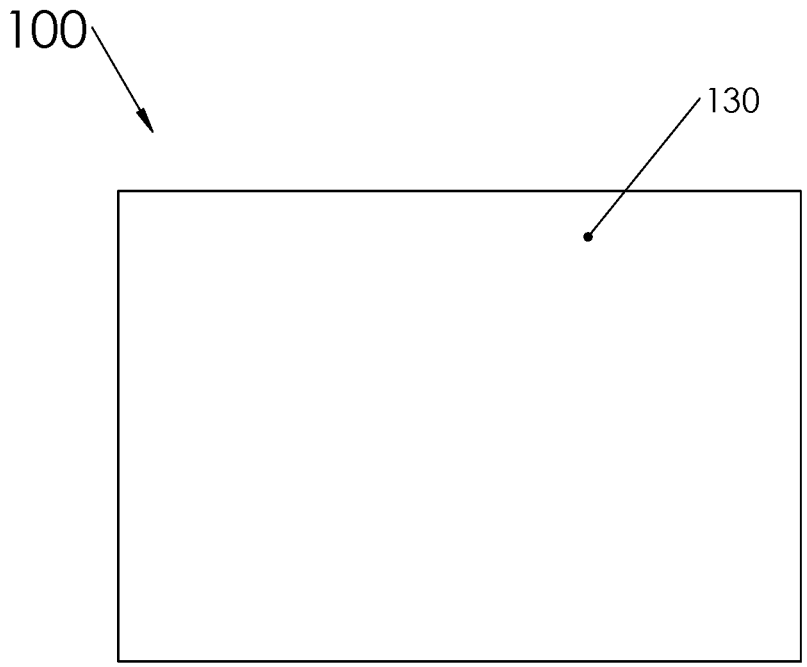
FIG. 11 is a top plan view of the narrow embodiment of elliptical silicone knuckle or roller.
Figure 12:
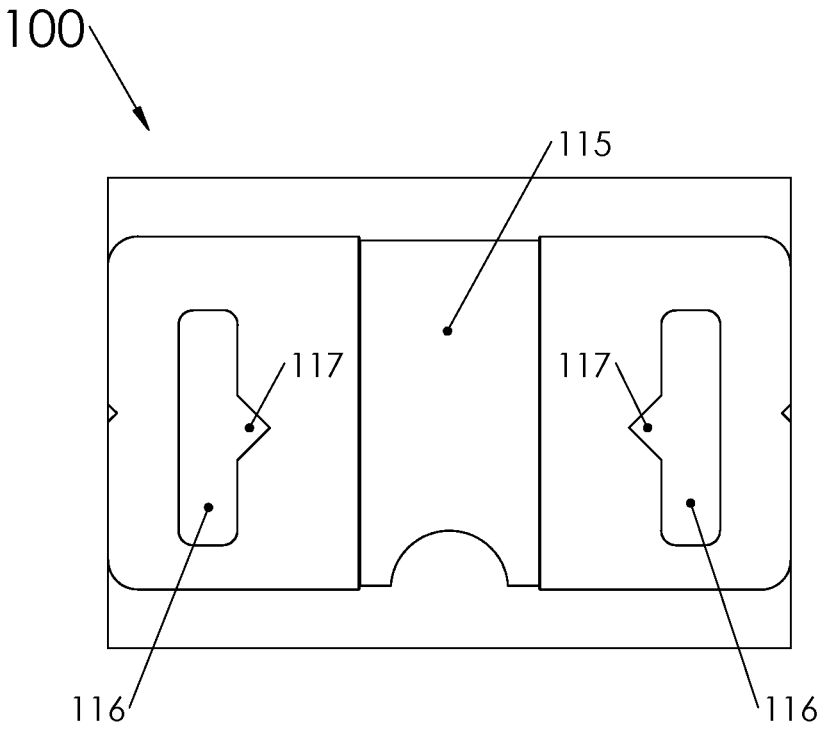
FIG. 12 is a bottom plan view of the narrow embodiment of elliptical silicone knuckle or roller.
Figure 13:
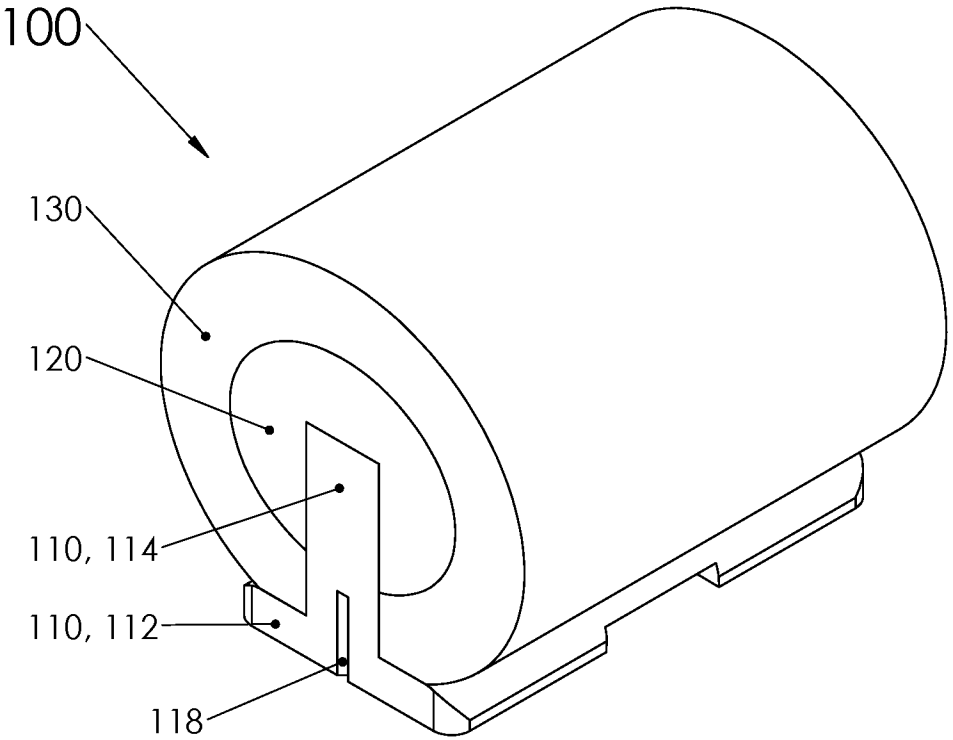
FIG. 13 is a perspective view of the wide embodiment of elliptical silicone knuckle or roller.
Figure 14:
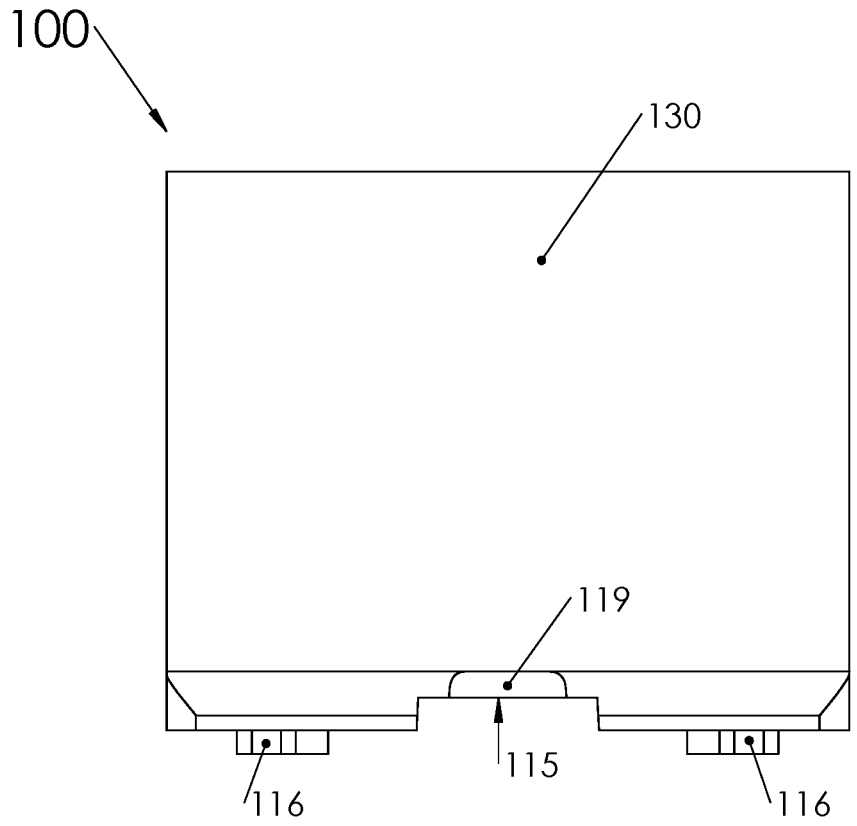
FIG. 14 is a front elevation view of the wide embodiment of elliptical silicone knuckle or roller.
Figure 15:
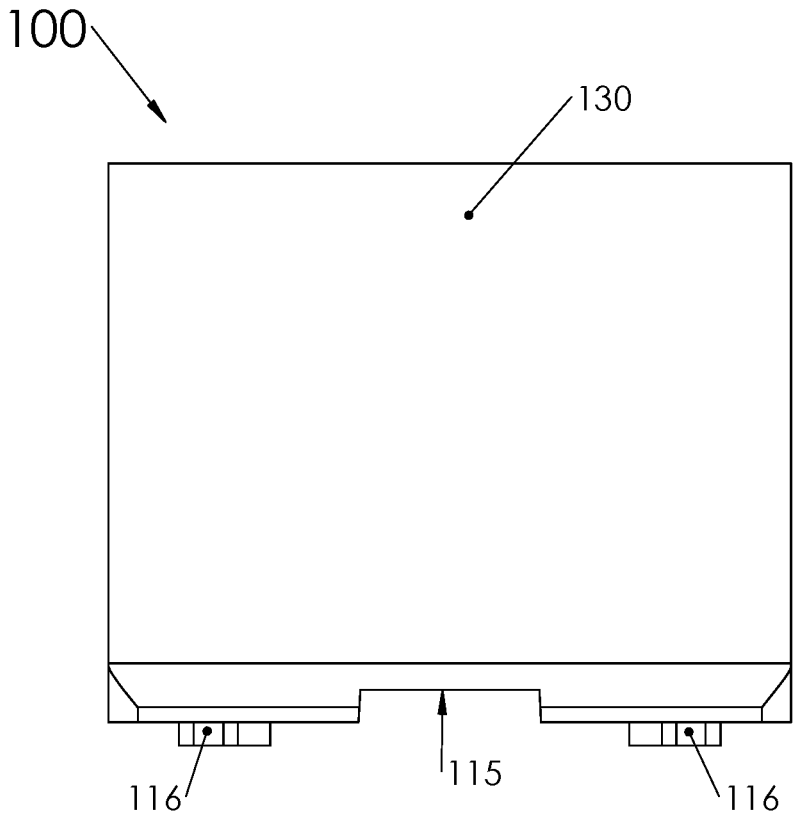
FIG. 15 is a rear elevation view of the wide embodiment of elliptical silicone knuckle or roller.
Figure 16:
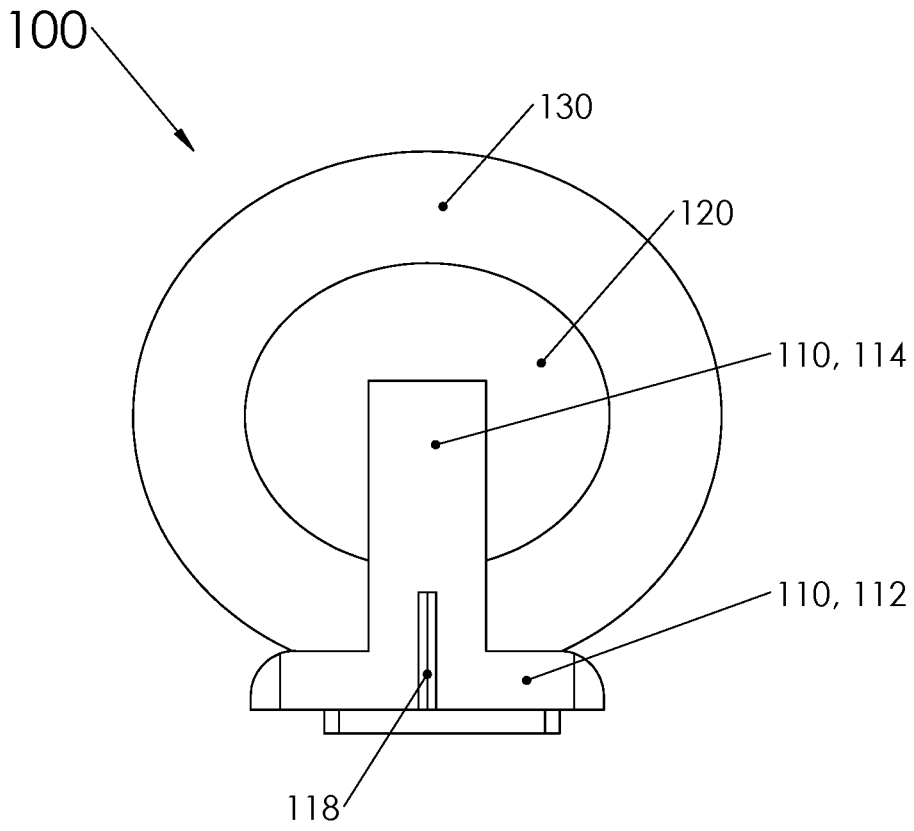
FIG. 16 is a left side elevation view of the wide embodiment of elliptical silicone knuckle or roller.
Figure 17:
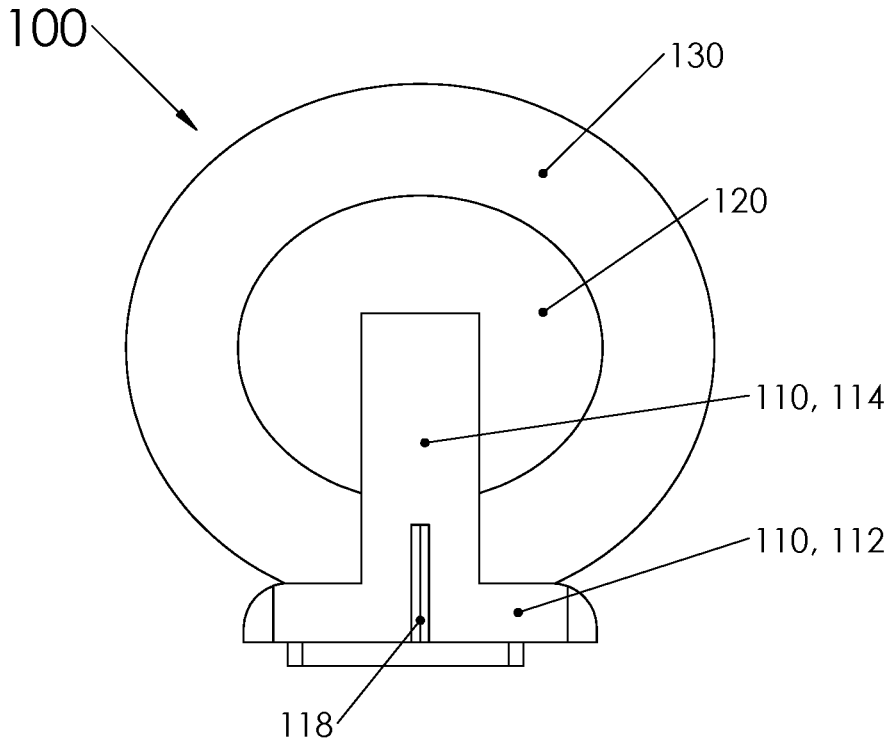
FIG. 17 is a right side elevation view of the wide embodiment of elliptical silicone knuckle or roller.
Figure 18:
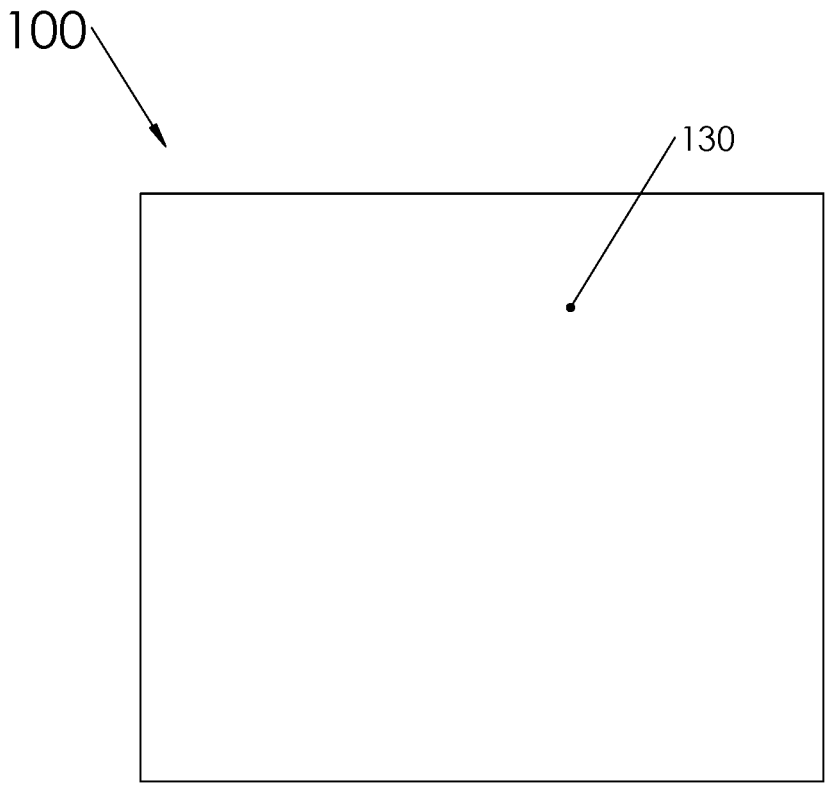
FIG. 18 is a top plan view of the wide embodiment of elliptical silicone knuckle or roller.
Figure 19:
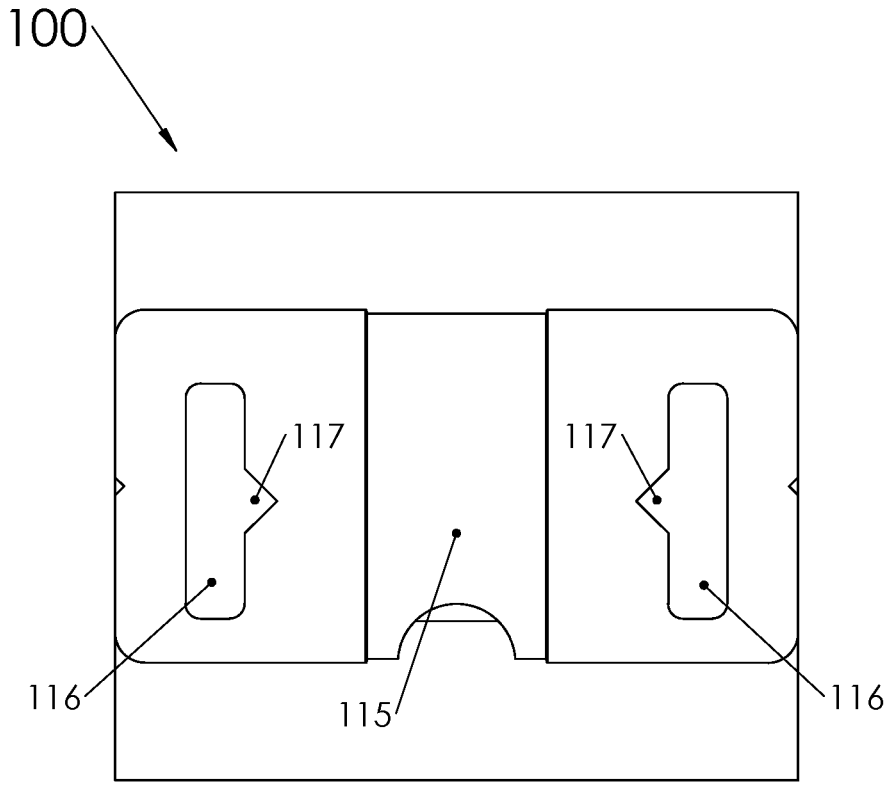
FIG. 19 is a bottom plan view of the wide embodiment of elliptical silicone knuckle or roller.

For pianists that prefer escapement that is smoother, longer, and dampened, applicant recommends the wide embodiment that is depicted in FIGS. 4-5 and 13-19. With this embodiment the major axis radius of the elliptical silicone core 120 is parallel with the plane of horizontal base member 112 and the minor axis radius is parallel with the plane of vertical upright member 114. With this embodiment, rectangular slot 122 is coincident with the minor axis radius of the elliptical cylinder. FIG. 4 depicts the wide embodiment of elliptical silicone knuckle or roller 100 with the piano action at rest. FIG. 5 depicts the wide embodiment of elliptical silicone knuckle or roller 100 with the piano action at the exact point of escapement. The wide embodiment depicted in FIGS. 4-5 and 13-19 yields a smoother escapement feel because the jack 40 slides down the outside surface or side of the wide embodiment of elliptical silicone knuckles or rollers 100 in a more gradual way and slower time in the same way that one falls down a steep hill harder and faster than one falls down a less steep or gradual incline.

For pianists that prefer escapement with minimum noticeability, applicant recommends the wide embodiment with a custom durometer reading of 40 units. To scale up the amount of feeling of escapement from this minimum, applicant molds a wide embodiment elliptical silicone core 120 with a durometer reading of greater than 40 with 1 unit increments.

Figure 2:
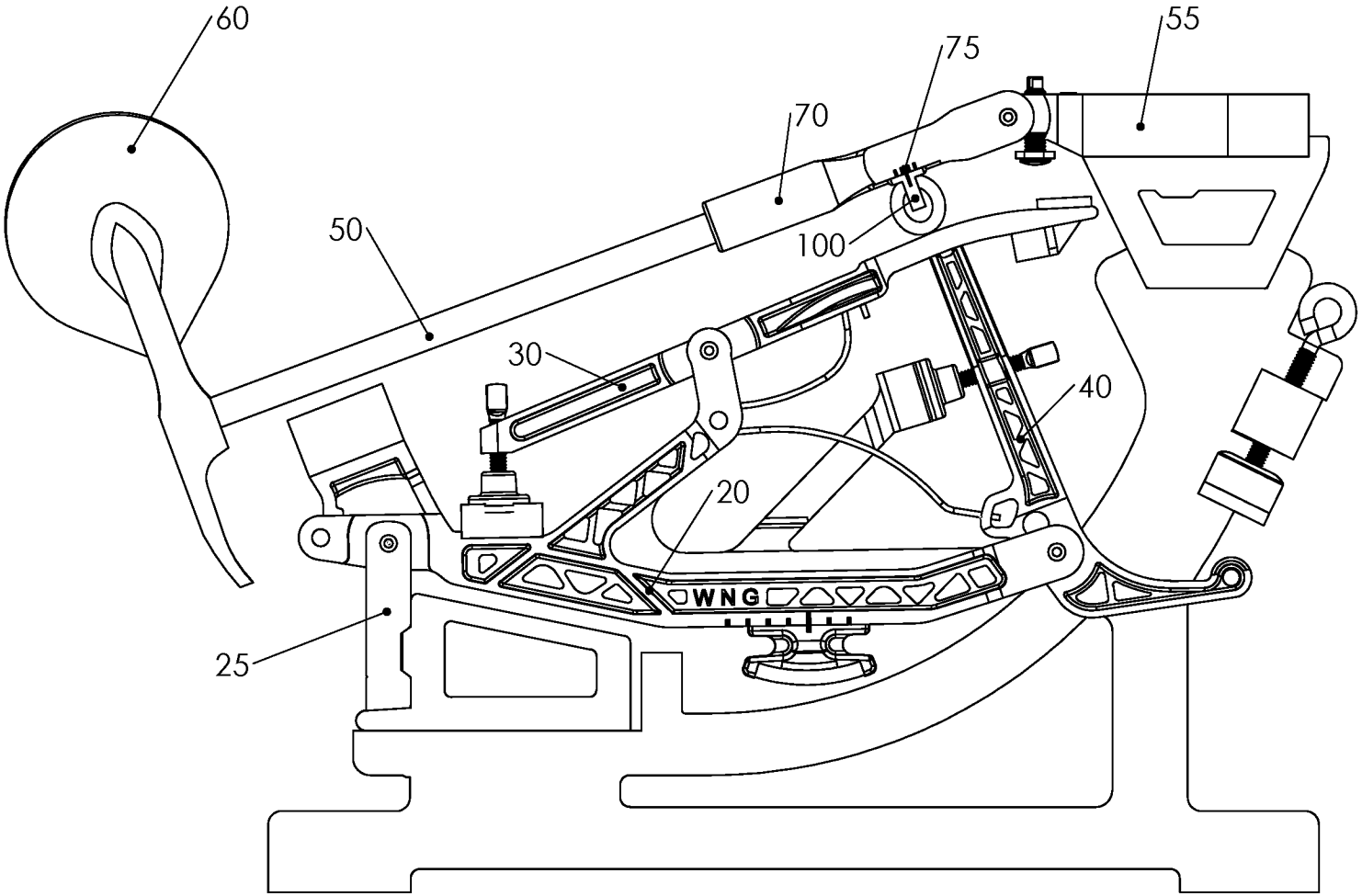
FIG. 2 is a side view of a piano action and hammer action with the narrow embodiment of elliptical silicone knuckle or roller with the piano action and hammer action at rest.
Figure 3:
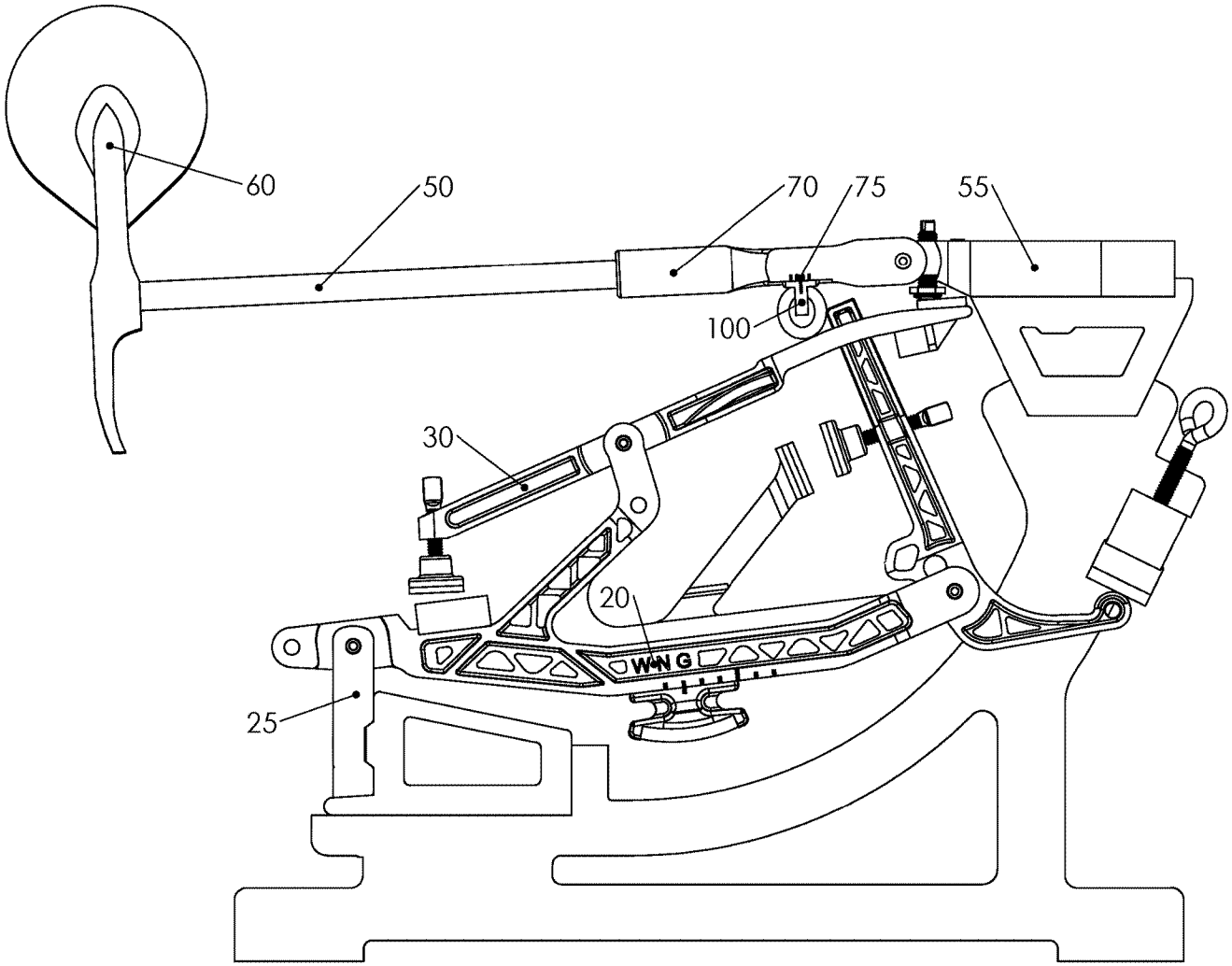
FIG. 3 is a side view of a piano action and hammer action with the narrow embodiment of elliptical silicone knuckle or roller with the piano action and hammer action at the exact point of escapement.

For pianists that prefer escapement that is harder, quicker, and with more of a bump, applicant recommends the narrow embodiment that is depicted in FIGS. 2-3 and 6-12. With this embodiment the major axis radius of the elliptical silicone core 120 is parallel with the plane of vertical upright member and the minor axis radius is parallel with the plane of horizontal base member 112. With this embodiment, rectangular slot 122 is coincident with the major axis radius of the elliptical cylinder. FIG. 2 depicts the narrow embodiment of elliptical silicone knuckle or roller 100 with the piano action at rest. FIG. 3 depicts the narrow embodiment of elliptical silicone knuckle or roller 100 with the piano action at the exact point of escapement. The narrow embodiment depicted in FIGS. 2-3 and 6-12 yields a bumpier escapement feel because the jack 40 slides down the outside surface or side of the narrow embodiment of elliptical silicone knuckles or rollers 100 in a more sudden way and faster time in the same way that one falls down a steep hill harder and faster than one falls down a less steep or gradual incline.

For pianists that prefer the maximum amount of feeling at escapement, applicant molds the narrow embodiment with a custom durometer reading of 100 units. To scale down the amount of feeling of escapement from this maximum, applicant molds a narrow embodiment elliptical silicone core 120 with a durometer reading of less than 100 with 1 unit increments.

A "medium" amount of feeling of escapement can be had with the narrow embodiment elliptical silicone core 120 with a custom durometer reading of about 60 units or the wide embodiment elliptical silicone core 120 with a custom durometer reading of about 70 units.

Applicant can deliver the exact desired feel of escapement by varying between the wide and narrow embodiments of elliptical silicone core 120 as well as custom targeting the durometer reading of the wide and narrow embodiments elliptical silicone core 120. By varying the durometer reading from 40-100 in integer increments for both the wide embodiment and the narrow embodiment of elliptical silicone core 120, Application can produce over 7,000 different options of elliptical silicone knuckle or roller 100 with this invention.

What is claimed is:

1. An elliptical silicone knuckle or roller for a grand piano action comprising: a spline; an elliptical silicone core, and a buckskin or wear cloth, wherein, said spline comprises: a horizontal base member and a vertical upright member, wherein, said horizontal base member is a rigid rectangular planar member with an upper surface, a lower surface, a front edge, a rear edge, a left edge, a right edge, a length, a width, a thickness, a plane, and a longitudinal bisect, said longitudinal bisect is an axis that runs from said left edge to said right edge that bisects said horizontal base member into two equal longitudinal halves, said horizontal base member has at least one recess area and at least one protrusion area, said at least one recess area is an indentation or concave area on said lower surface of said horizontal base member, said at least one protrusion area is a projection or convex area on said lower surface of said horizontal base member, said at least one protrusion area further comprises a pointer, said pointer is a protrusion or projection on said lower surface of horizontal base member that is shaped like an arrowhead, pointer, or point, said horizontal base member further comprises a first location mark and a second location mark, said first location mark is a protrusion or recess on said left side of said horizontal base member that is a line with a longitudinal axis that is perpendicular to said plane of said horizontal base member wherein said longitudinal axis of said first location mark is coincident with said longitudinal bisect of said horizontal base member, said first location mark has an upper end a lower end, wherein said lower end lower end of said first location mark is adjacent to said lower surface of said horizontal base member, said second location mark is a protrusion or recess on said right side of said horizontal base member that is a line with a longitudinal axis that is perpendicular to said plane of said horizontal base member wherein said longitudinal axis of said first location mark is coincident with said longitudinal bisect of said horizontal base member, said second location mark has an upper end a lower end, wherein said lower end lower end of said second location mark is adjacent to said lower surface of said horizontal base member, said vertical upright member is a rigid rectangular planar member with an upper edge, a lower edge, a front surface, a rear surface, a left edge, a right edge, a length, a width, a thickness, and a plane, said lower edge of said vertical upright member is rigidly attached to said upper surface of said horizontal base member along said longitudinal bisect of said horizontal base member wherein said plane of said vertical upright member is perpendicular to said plane of said horizontal base member, said elliptical silicone core is a solid silicone elliptic cylinder shaped member with a left end, a right end, an outer surface, a length, a longitudinal axis, a major axis radius, a minor axis radius, and a length, said major axis radius is perpendicular to said minor axis radius, said major axis radius is larger than said minor axis radius to yield an elliptical shaped cross section of said solid silicone elliptic cylinder shaped member, said major axis radius of said elliptical silicone core is parallel with said plane of said horizontal base member and said minor axis radius of said elliptical silicone core is parallel with said plane of said vertical upright member so that said rectangular slot is coincident with said minor axis radius of said elliptical cylinder, said elliptical silicone core further comprises a rectangular slot in said outer surface of said elliptical silicone core, said rectangular slot has a left end, a right end, a depth, a width, a length, and a longitudinal axis, said longitudinal axis of said rectangular slot is parallel with said longitudinal axis of said elliptical silicone core, said left end of said rectangular slot is coincident with said left end of said elliptical silicone core, said right end of said rectangular slot is coincident with said right end of said elliptical silicone core, said left end of said rectangular slot breaks out of said left end of said elliptical silicone core, said right end of said rectangular slot breaks out of said right end of said elliptical silicone core, said buckskin or wear cloth is a rectangular piece a woven or non-woven fabric, textile, or cloth, said buckskin or wear cloth has an inner surface, an outer surface, a length, width, and a thickness, said inner surface of said buckskin or wear cloth is attached to or glued to said outer surface of said elliptical silicone core so that said buckskin or wear cloth evenly covers said outer surface of said elliptical silicone core without any overhang over said left end, said right end, or said rectangular slot of said elliptical silicone core, said buckskin or wear cloth is not stretched during said attachment or said gluing but rather is draped without any increased tension or pulling on said buckskin or wear cloth, and said elliptical silicone core is rigidly attached to said vertical upright member by inserting said upper edge of said vertical upright member into said rectangular slot of said elliptical silicone core with a glue, weld, solder, epoxy, or adhesive therebetween.

2. An elliptical silicone knuckle or roller for a grand piano action comprising: a spline; an elliptical silicone core, and a buckskin or wear cloth, wherein, said spline comprises: a horizontal base member and a vertical upright member, wherein, said horizontal base member is a rigid rectangular planar member with an upper surface, a lower surface, a front edge, a rear edge, a left edge, a right edge, a length, a width, a thickness, a plane, and a longitudinal bisect, said longitudinal bisect is an axis that runs from said left edge to said right edge that bisects said horizontal base member into two equal longitudinal halves, said horizontal base member has at least one recess area and at least one protrusion area, said at least one recess area is an indentation or concave area on said lower surface of said horizontal base member, said at least one protrusion area is a projection or convex area on said lower surface of said horizontal base member, said at least one protrusion area further comprises a pointer, said pointer is a protrusion or projection on said lower surface of horizontal base member that is shaped like an arrowhead, pointer, or point, said horizontal base member further comprises a first location mark and a second location mark, said first location mark is a protrusion or recess on said left side of said horizontal base member that is a line with a longitudinal axis that is perpendicular to said plane of said horizontal base member wherein said longitudinal axis of said first location mark is coincident with said longitudinal bisect of said horizontal base member, said first location mark has an upper end a lower end, wherein said lower end lower end of said first location mark is adjacent to said lower surface of said horizontal base member, said second location mark is a protrusion or recess on said right side of said horizontal base member that is a line with a longitudinal axis that is perpendicular to said plane of said horizontal base member wherein said longitudinal axis of said first location mark is coincident with said longitudinal bisect of said horizontal base member, said second location mark has an upper end a lower end, wherein said lower end lower end of said second location mark is adjacent to said lower surface of said horizontal base member, said vertical upright member is a rigid rectangular planar member with an upper edge, a lower edge, a front surface, a rear surface, a left edge, a right edge, a length, a width, a thickness, and a plane, said lower edge of said vertical upright member is rigidly attached to said upper surface of said horizontal base member along said longitudinal bisect of said horizontal base member wherein said plane of said vertical upright member is perpendicular to said plane of said horizontal base member, said elliptical silicone core is a solid silicone elliptic cylinder shaped member with a left end, a right end, an outer surface, a length, a longitudinal axis, a major axis radius, a minor axis radius, and a length, said major axis radius is perpendicular to said minor axis radius, said major axis radius is larger than said minor axis radius to yield an elliptical shaped cross section of said solid silicone elliptic cylinder shaped member, said major axis radius of said elliptical silicone core is parallel with said plane of said vertical upright member and said minor axis radius is parallel with said plane of said horizontal base member so that said rectangular slot is coincident with said major axis radius of said elliptical cylinder, said elliptical silicone core further comprises a rectangular slot in said outer surface of said elliptical silicone core, said rectangular slot has a left end, a right end, a depth, a width, a length, and a longitudinal axis, said longitudinal axis of said rectangular slot is parallel with said longitudinal axis of said elliptical silicone core, said left end of said rectangular slot is coincident with said left end of said elliptical silicone core, said right end of said rectangular slot is coincident with said right end of said elliptical silicone core, said left end of said rectangular slot breaks out of said left end of said elliptical silicone core, said right end of said rectangular slot breaks out of said right end of said elliptical silicone core, said buckskin or wear cloth is a rectangular piece a woven or non-woven fabric, textile, or cloth, said buckskin or wear cloth has an inner surface, an outer surface, a length, width, and a thickness, said inner surface of said buckskin or wear cloth is attached to or glued to said outer surface of said elliptical silicone core so that said buckskin or wear cloth evenly covers said outer surface of said elliptical silicone core without any overhang over said left end, said right end, or said rectangular slot of said elliptical silicone core, said buckskin or wear cloth is not stretched during said attachment or said gluing but rather is draped without any increased tension or pulling on said buckskin or wear cloth, and said elliptical silicone core is rigidly attached to said vertical upright member by inserting said upper edge of said vertical upright member into said rectangular slot of said elliptical silicone core with a glue, weld, solder, epoxy, or adhesive therebetween.

* * * * *